US006266894B1

(12) United States Patent
Conochie

(10) Patent No.: US 6,266,894 B1
(45) Date of Patent: Jul. 31, 2001

(54) LIQUID/GAS/SOLID SEPARATION VESSEL APPARATUS

(75) Inventor: David Stewart Conochie, Camberwell (AU)

(73) Assignee: KFx Inc., Denver, CO (US)

( * ) Notice: Subject to any disclaimer, the term of this patent is extended or adjusted under 35 U.S.C. 154(b) by 0 days.

(21) Appl. No.: 09/367,083

(22) PCT Filed: Mar. 26, 1998

(86) PCT No.: PCT/AU98/00204

§ 371 Date: Nov. 8, 1999

§ 102(e) Date: Nov. 8, 1999

(87) PCT Pub. No.: WO98/42427

PCT Pub. Date: Oct. 1, 1998

(30) Foreign Application Priority Data

Mar. 26, 1997 (AU) ..... PO5890

(51) Int. Cl.[7] ..... F26B 3/00

(52) U.S. Cl. ..... 34/356; 34/360; 34/370; 34/95; 34/216

(58) Field of Search ..... 34/353, 356, 360, 34/370, 391, 95, 216, 228; 422/213, 216, 219; 210/749, 758, 759, 760; 110/338, 210, 212

(56) References Cited

U.S. PATENT DOCUMENTS

| | | | | |
|---|---|---|---|---|
| 4,543,190 | * | 9/1985 | Modell | 210/721 |
| 4,626,258 | | 12/1986 | Koopelman . | |
| 4,787,915 | * | 11/1988 | Meyer et al. | 44/51 |
| 5,106,513 | * | 4/1992 | Hong | 210/759 |
| 5,208,998 | * | 5/1993 | Oyler, Jr. | 34/92 X |
| 5,290,523 | | 3/1994 | Koppelman . | |
| 5,361,514 | * | 11/1994 | Lahoda et al. | 34/391 |
| 5,522,156 | * | 6/1996 | Ware | 34/356 |
| 5,577,333 | * | 11/1996 | Schick et al. | 34/360 |
| 5,656,178 | * | 8/1997 | Marchesi et al. | 210/770 |
| 5,946,818 | * | 9/1999 | Baxter et al. | 34/379 |

FOREIGN PATENT DOCUMENTS

| | | |
|---|---|---|
| 42969/78 | 8/1979 | (AU) . |
| 47456/93 A | 3/1994 | (AU) . |
| 19532979 A1 | 3/1997 | (DE) . |
| 19620047 A1 | 11/1997 | (DE) . |

OTHER PUBLICATIONS

Derwent Abstract Accession No. 99–324123/46, Class Q76, DD 238461 A (Orgreb Inst KraftW) Mar. 30, 1987.

PCT International Preliminary Examination Report (Form PCT/IPEA/409), dated Jul. 2, 1999 (4 pages).

PCT International Search Report (Form PCT/ISA0210), dated May 20, 1998 (6 pages).

* cited by examiner

*Primary Examiner*—Stephen Gravini
(74) *Attorney, Agent, or Firm*—Harness, Dickey & Pierce, P.L.C.

(57) ABSTRACT

A process and an apparatus for processing a charge of a solid material under conditions which include high mass flow rate of gas through the apparatus and which produce liquid from the solid material is disclosed. The apparatus includes a vessel having (i) an inlet end having an inlet for supplying the solid material to form a packed bed in the vessel; and (ii) an outlet end having at least one solids outlet, at least one liquids outlet. The apparatus is characterised by the at least one gas outlet being positioned above the solids/liquid outlets.

24 Claims, 2 Drawing Sheets

LIQUID/GAS/SOLID SEPARATION VESSEL APPARATUS

FIELD OF THE INVENTION

The present invention relates to processing a charge of solid material in a vessel under conditions which include high mass flow rate of gas through the vessel and removal of gas from the vessel.

BACKGROUND AND SUMMARY OF THE INVENTION

The present invention extends to processing solid material by heating or by cooling.

The present invention relates particularly, although by no means exclusively, to processing a charge of solid material (which, optionally, has a low thermal conductivity) in a vessel under conditions (which include high pressure and temperature) that produce liquid from the solid material and high mass flow rate of gas (produced from the solid material and/or added to the vessel as part of the process).

The present invention relates more particularly to a process and an apparatus for upgrading carbonaceous materials, typically coal, particularly low rank coal, under conditions which include high pressure and temperature to increase the BTU value of the carbonaceous materials by removing water from the carbonaceous materials, which process and apparatus includes separating solids, liquid, and gas phases produced by or supplied to the process.

The following discussion of the prior art is in relation to difficulties separating solids, gas and liquid phases produced when coal is dewatered by heating the coal under elevated pressure conditions. It is noted that in more general terms the present invention extends to difficulties caused by high mass flow rate of gas through vessels containing solids, with or without liquid present, under heating or cooling conditions.

U.S. Pat. No. 5,290,523 to Koppelman discloses a process for upgrading coal by the simultaneous application of pressure and temperature.

Koppelman discloses thermal dewatering of coal by heating coal under conditions which include elevated pressure and temperature to cause physical changes in the coal that results in water being removed from the coal by a "squeeze" reaction.

Koppelman also discloses maintaining the pressure sufficiently high during the upgrading process so that the by-product water is produced mainly as a liquid rather than steam.

Koppelman also discloses a range of different apparatus options for carrying out the upgrading process. In general terms, the options are based on the use of a pressure vessel which includes an inverted conical inlet, a cylindrical body, a conical outlet with a single outlet at the apex of the conical outlet, ie the lowest section of the vessel, and an assembly of vertically or horizontally disposed heat exchange tubes positioned in the body.

In one proposal to use a Koppelman-type apparatus, the vertically disposed tubes and the outlet end are packed with coal, and nitrogen is injected to pressurise the tubes and the outlet end. The coal is heated by indirect heat exchange with a heat exchange medium supplied to the cylindrical body externally of the tubes. Further heat is generated by supplying water to the tubes, which subsequently forms steam that acts as a heat transfer medium. The combination of elevated pressure and temperature conditions evaporates some of the water from the coal and thereafter condenses some of the water as a liquid. A portion of the steam generated following the addition of water also condenses as a liquid due to the elevated pressure. Steam which is not condensed, and which is in excess of the requirements for optimum pressurisation of the packed bed, must be vented. In addition, noncondensable gases (eg CO, $CO_2$) are evolved and need to be vented. Periodically, liquid is drained from the outlet end. Finally, after a prescribed residence time, the vessel is depressurised and the upgraded coal is discharged via the same outlet end.

It has been found that the configuration of the outlet end of the above-described Koppelman-type apparatus has not been altogether satisfactory in terms of separating the solid/liquid/gas phases and, more particularly liquid/gas phases. The problems encountered include high pressure drop and high gas velocity in the outlet end which results in:

(i) two phase flow of liquid and gas from the outlet end that is difficult to control;

(ii) blockage preventing discharge; and (iii) fine and sometimes coarse material being discharged with liquid (and gas).

More particularly, in general terms, gas and liquid exiting a vessel through the same outlet duct tend to flow in a most irregular fashion due to the different flow resistances of the gas and liquid in the bed, ducts and control valves. The compressible nature of the gas, the rapidly varying resistances, and the comparatively high density of the liquid leads to a flow with high acceleration forces which can lead to disturbance and probable transport of particles in the packed bed.

One object of the present invention is to provide improved separation of solids, liquid, and gas generated in or supplied to the Koppelman-type apparatus.

A more general object of the present invention is to provide an apparatus for separating solids, liquid, and gas in pressure vessels operated at high pressures and temperatures.

A further more general object of the present invention is to provide an apparatus for introducing and/or removing high mass flow rate of gas into and/or from vessels containing solid material which is being processed in the vessels.

The term "high" in the context of "mass flow rate of gas" is understood herein as indicating that the total amount of the gas is a significant proportion, typically 5–10%, of the mass of the solid material and/or that the mass flow rate of gas approaches the threshold for fluidising the solid material in the vessel.

In the broadest sense, the present invention provides an improvement to a vessel for processing a charge of solid material under conditions which include high mass flow rate of gas through the vessel, the improvement including providing the vessel with at least one solids outlet for discharging solids from the vessel and a plurality of gas inlets and/or gas outlets for introducing gas into or discharging gas from the vessel at one or more levels of the vessel above the gas outlet or outlets.

More particularly, according to the present invention there is provided an improvement to a vessel for processing a charge of solid material under conditions which include high mass flow rate of gas through the vessel and which produce liquid from the solid material, the improvement including an outlet end of the vessel having at least one solids outlet, at least one liquids outlet, and at least one gas outlet, and the at least one gas outlet being positioned above the at least one solids outlet and the at least one liquid outlet.

The aspect of the present invention described in the preceding paragraph is based on the realisation that effective separation of solids, liquid, and gas from a vessel, with minimum entrainment of solids and gas with liquid, can be achieved by providing separate removal of liquid and gas at different levels of the outlet end, and with the gas outlet (or outlets) being at a higher level than that of the liquid outlet (or outlets).

This aspect of the present invention can also be described as an apparatus for processing a charge of a solid material under conditions which include high mass flow rate of gas through the apparatus and which produce liquid from the solid material, which apparatus includes:

(a) a vessel having:
  (i) an inlet end having an inlet for supplying the solid material to form a packed bed in the vessel; and
  (ii) an outlet end having at least one solids outlet, at least one liquids outlet, and at least one gas outlet positioned above the solids/liquid outlets;
(b) a means for supplying a fluid to pressurise the packed bed; and
(c) a means for supplying a heat exchange medium to heat the solid material in the packed bed.

It is preferred that the outlet end be in a lower section of the vessel.

It is preferred that the outlet end converges to one (or possibly more) solids outlets.

It is preferred particularly that the outlet end be conical.

It is preferred that the outlet end includes a plurality of gas outlets.

It is preferred that the gas outlets be located at more than one level of the outlet end.

It is preferred that there be a plurality of gas outlets at least at one level of the outlet end.

Preferably, at each level that has a plurality of gas outlets, the gas outlets are spaced around the perimeter of the vessel so that across that level there is substantially uniform downward mass flow rate of gas.

In more general terms, the number and location and structure of the gas outlets is governed by:

(i) the need to progressively remove gas at different levels down the outlet end such that the mass flow per unit cross section (or velocity) in the packed bed is maintained approximately constant at each level;
(ii) the need to draw gas at each level towards a gas outlet without creating regions of high gas velocity which may lead to high pressure drop and/or entrainment of solids and/or liquid; and
(ii) the need to turn the gas flow from downward to outward lateral flow whilst at the same time allowing any liquid to continue in a substantially downward direction.

It is noted that the term "fluid" as used in paragraph (b) above is sufficiently broad to cover the use of a gas, such as nitrogen, and a liquid, such as water, introduced into the vessel.

It is preferred that the means for supplying the heat exchange medium supplies the medium to heat the solid material by indirect heat exchange.

It is preferred that the vessel be a pressure vessel.

The above-described particular aspect of the present invention can also be described as a process for processing a charge of a solid material under conditions which include high mass flow rate of gas and which produce liquid from the solid material, which process includes:

(a) supplying the solid material to a vessel to form a packed bed of the solid material;
(b) pressurising the packed bed;
(c) heating the solid material by heat exchange with a heat exchange medium, whereby the combined effect of pressure and heat is to release water and other liquid and/or gaseous compounds from the, solid material, with part of the released water being in a gas phase and part of the water being in a liquid phase;
(d) discharging gas from the packed bed via at least one gas outlet in the vessel; and
(e) discharging liquid from the packed bed via a liquid outlet in the vessel located below the gas outlet.

The process may include introducing gas to the vessel as a working fluid to contribute to heat transfer to the solid material.

It is noted that step (d) of discharging gas may include removal of an amount of liquid. It is also noted that step (e) of discharging liquid may include removal of an amount of gas.

It is preferred that the basis for discharging gas from the packed bed be to control:

(i) the pressure drop in the outlet end; and/or
(ii) the flow of gas into the section of the outlet end that is below the level of the gas outlet.

It is preferred particularly that the process includes discharging gas from the packed bed via a plurality of gas outlets so that there is substantially constant flow velocity of gas in the section of the outlet end below the level of the gas outlets.

It is preferred that the basis for discharging liquid from the packed bed be the level of liquid in the outlet end at any point in time during operation of the process such that discharge via the liquid outlet is predominantly liquid.

It is preferred that the process includes discharging gas from the packed bed via gas outlets at two or more levels above the liquid outlet.

It is preferred that the process includes discharging gas via a plurality of gas outlets at least at one of the levels above the liquid outlet.

It is preferred that the vessel includes an outlet end that converges to one (or possibly more) solids outlets.

It is preferred particularly that the vessel includes a conical outlet end and that the gas outlet or outlets and the liquid outlet be located in the outlet end.

BRIEF DESCRIPTION OF THE DRAWINGS

The present invention is described further by way of example with reference to the accompanying drawings of which.

DETAILED DESCRIPTION OF THE PREFERRED EMBODIMENTS

The following description is predominantly in the context of upgrading coal. It is noted that the present invention is not so limited and extends to processing any suitable solid material.

Furthermore, the following description is predominantly in the context of the Koppelman-type apparatus described above. It is noted that the present invention is not so limited and has general application to processing solid material under elevated pressure and temperature conditions which requires separation of solid, liquid and gas during and/or at the end of the processing.

By way of further specific example, the present invention extends to the apparatus (and the process) described in International patent applications PCT/AU98/00005 and PCT/AU98/00142 in the name of the applicant, and the disclosure in these International patent applications is incorporated herein by way of cross-reference.

Figure 1:
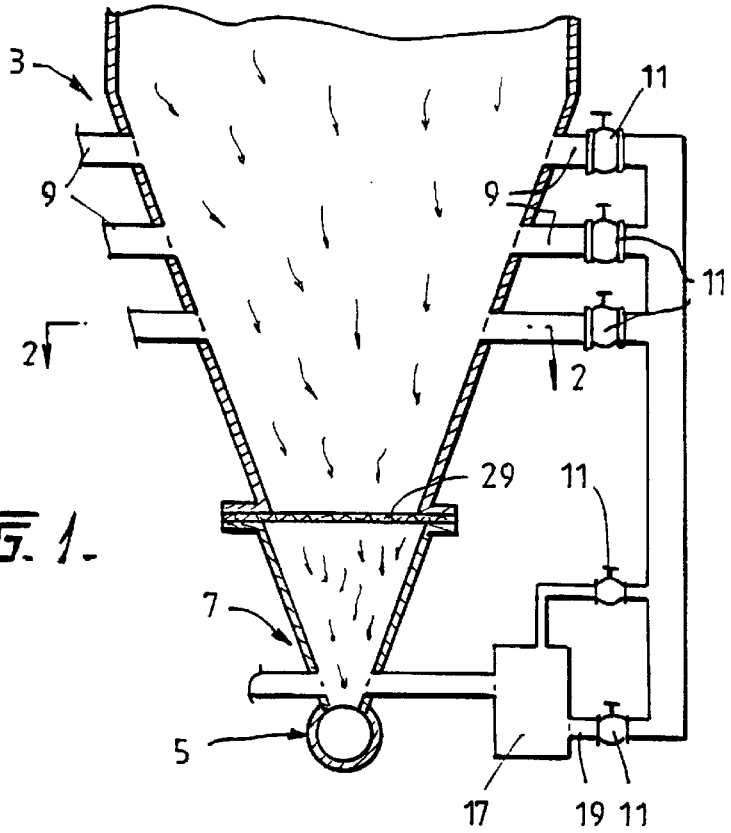
FIG. 1 is a schematic diagram of an outlet end of one preferred embodiment of an apparatus in accordance with the present invention.
Figure 2:
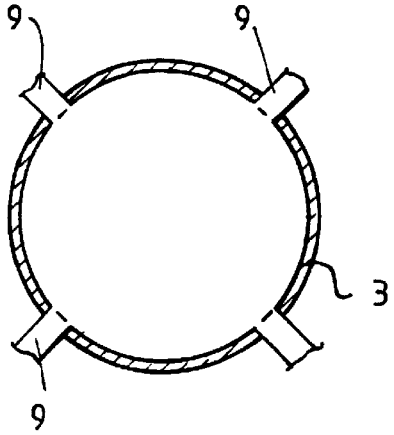
FIG. 2 is a cross-section along the line 2—2 in FIG. 1.

With reference to FIGS. 1 and 2, the apparatus includes a pressure vessel having an outlet end, generally identified by the numeral 3, in the form of a cone.

The outlet end 3 comprises:

(i) a solids outlet 5 in the end of the cone;

(ii) a liquid outlet 7 in a lower section of the cone;

(iii) a plurality of gas outlets 9 at different levels of the cone above the solids/liquids outlets 5,7 and, as can best be seen in FIG. 2, with more than one gas outlet 9 at each of the levels; and (iv) optionally, a solids retention means 29.

It is noted that the present invention is not limited to a conical outlet end and, by way of example, extends to any outlet end that converges to one or more solids outlets.

The above-described locations of the liquid/gas outlets 7,9 enable separate liquid separation and gas separation from liquid and gas that, in use, flow downwardly through the vessel to the outlet end 3. Specifically, the gas outlets 9 allow progressive removal of gas as the gas flow converges in the cone towards the lower end of the cone.

The solids/liquid/gas outlets 5, 7, 9 may be of any suitable form.

In the case of the gas outlets 9, the outlets may be in any suitable form and location bearing in mind the need:

(i) to progressively remove gas at different levels down the cone such that the mass flow per unit transverse cross-section of the cone (or the velocity) in the packed bed is maintained substantially constant at each level; and (ii) to draw gas at each level towards an outlet means without creating regions of high gas velocity which may lead to high pressure drop and/or entrainment of solids and/or liquids.

The preferred embodiment of the present invention, as shown in FIG. 2, includes a series of discrete gas outlets 9 spaced around the perimeter of the vessel at a given level. This arrangement results in general outward flow of part of the downwardly flowing gas towards the perimeter of the vessel and thereafter from the vessel via the outlets.

Alternatively, by way of example, there may be a substantially continuous outlet (not shown) around the perimeter of the vessel at each level which ensures that there is a uniform outward movement of gas towards the perimeter of the vessel.

The solids/liquid/gas outlets 5, 7, 9 include valve means 11 that are selectively operable to allow solids, liquids, and gas to discharge from the outlet end 3.

The valve means 11 are positioned as close as possible to the vessel so that there is minimal duct work between the vessel and the valve means to minimise mass flux of gas through the outlet end during start-up.

The apparatus further includes a relatively small holding tank 17 connected to the liquids outlet 7 for receiving liquid discharged from the outlet end. The holding tank 17 has an outlet line 19 in a lower section which is controlled by a valve means 11. In use, liquid is discharged from the holding tank 17 via the outlet line 19.

In use of the apparatus to dewater coal, a charge of coal is supplied to the vessel and, more particularly to the outlet end 3 and the tubes (not shown) of the apparatus. Thereafter:

(i) nitrogen is pumped into the packed bed of coal in the tubes and the outlet end 3 to pressurise the packed bed, typically to a pressure of 100–200 psi;

(ii) a heat exchange medium is supplied to the vessel externally of the tubes to heat the coal by indirect heat exchange, typically to a temperature of 520° F.; and (iii) water is supplied to the packed bed to provide a source of steam.

The steam produced in the packed bed from the inlet feed of water contributes to the pressure in the packed bed and provides a means for further heating of the coal. In addition, as noted above, steam evolved from the water in the coal also contributes to the pressure in the packed bed. The combination of these factors pressurises the packed bed to an operating pressure, typically 700 psi.

The combined effect of the elevated pressure and temperature is to evaporate or squeeze water from the coal in the packed bed and to condense the water at progressively lower levels in the vessel. The "squeeze" reaction is caused by structural realignment of the coal and also by decarboxylation reactions.

The liquid collects in the outlet end 3 of the vessel and periodically is removed via the liquid outlet 7 into the holding tank 17.

As discussed above, the location of the solids/liquid/gas outlets 5, 7, 9 at different levels makes it possible to have separate removal of solids, liquid, and gas, and more particularly liquid and gas, from the outlet end 3.

Moreover, the removal of gas from the vessel via the gas outlets 9 separately to removal of the liquid makes it possible to avoid high pressure drop in the outlet end and high flow rates of gas in the lower section of the outlet end 3.

Figure 3:
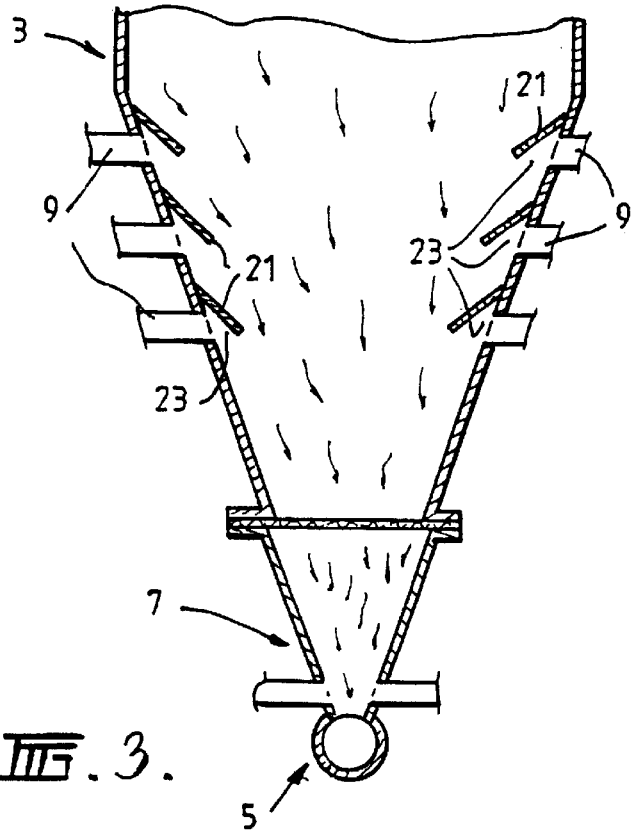
FIG. 3 is a schematic diagram of an outlet end of another preferred embodiment of an apparatus in accordance with the present invention.

With reference to FIG. 3, in order to minimise loss of liquid and solids via the gas outlets 9, one preferred embodiment of the present invention includes plates or screens 21 positioned in relation to the gas outlets 9 to initially deflect downward flow of solids, liquids, and gas away from the gas outlets 9. In addition, the plates/screens 21 define downwardly opening channels 23. The arrangement is such that gas can flow outwardly and upwardly around the lower end of the plates/screens 21 into the channels 23 and then to the gas outlets 9. It can readily be appreciated that the outward and upward flow of gas around the plates/screens 21 minimises entrainment of liquids and solids. In addition, the generally solids-free channels 23 allow the gas to accelerate to the gas outlets 9.

Figure 4:
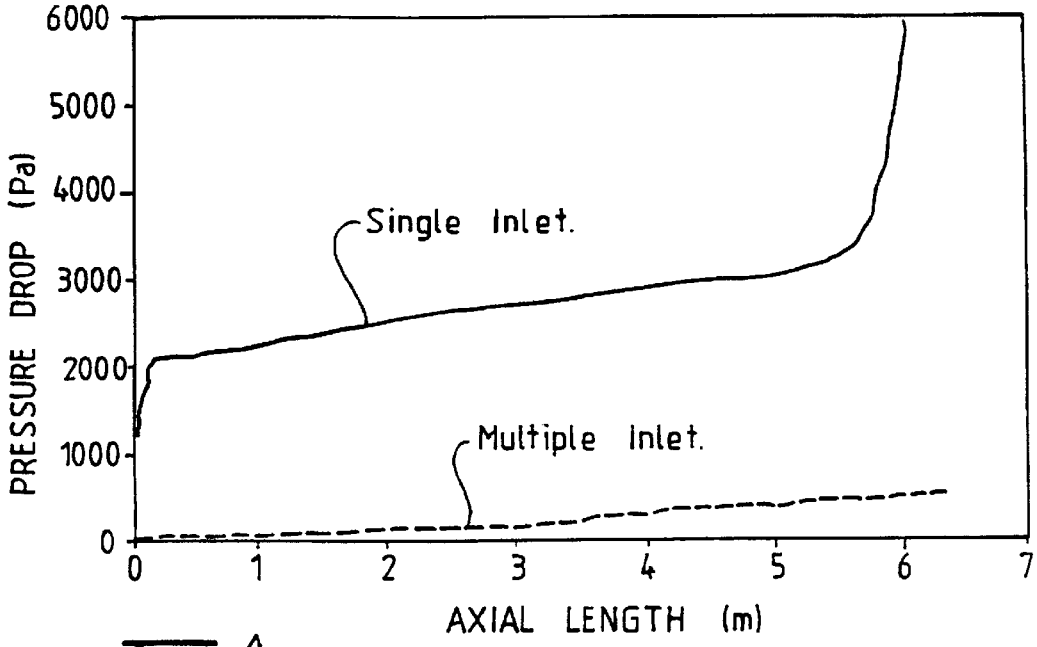
FIG. 4 is a plot of pressure drop along the length of a vessel which was produced during computational fluid dynamics ("cfd") modelling work carried out for the applicant.
Figure 5:
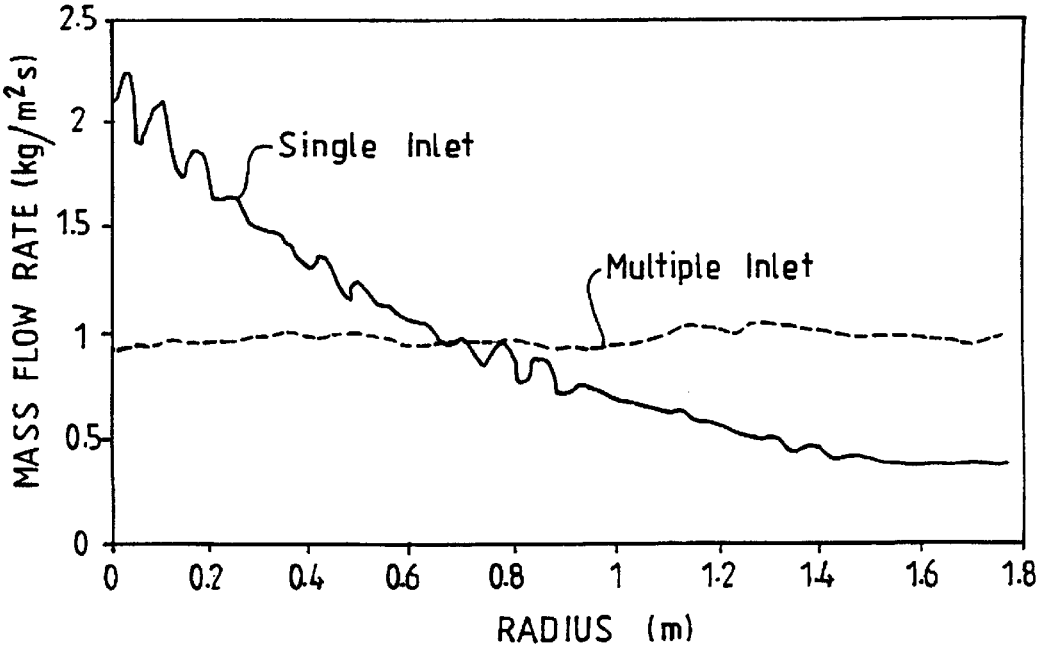
FIG. 5 is a plot of mass flow rate at a level 3 m from the base of a vessel from the axial centreline to the perimeter of the vessel which was produced during cfd modelling work carried out for the applicant.

An axi-symmetric vertical slice cfd model was developed for the applicant to investigate the present invention. The model was based on gas injection via multiple inlets located above a single solids outlet in a vessel operated to cool a packed bed of solid material in the vessel. The model was based on aspects of the process and apparatus described in the International applications referred to above. The results of the modelling work are summarised in part in FIGS. 4 and 5. The modelling work compared the effect of a conventional single gas inlet/outlet with a multiple gas inlet/outlet as proposed by the present invention. With reference to FIG. 4, the modelling work established that multiple gas inlets/outlets in accordance with the present invention had the significant advantage of causing a significantly lower pressure drop along the length of the vessel compared to the pressure drop caused by a conventional single gas inlet/outlet. With reference to FIG. 5, the modelling work established that multiple gas inlets/outlets in accordance with the present invention had the significant advantage of causing a substantially uniform mass flow rate through the vessel across the vessel compared with the non-uniform mass flow rate caused by a conventional single gas inlet/outlet.

Many modifications may be made of the preferred embodiment without departing from the spirit and scope of the present invention.

By way of example, whilst the preferred embodiment includes a single solids outlet 5 and a single liquids outlet 7, it can readily be appreciated that the present invention is not so limited and extends to arrangements which include more than one solids outlet 5 and/or more than one liquids outlet 7.

What is claimed is:

1. In a vessel for processing a charge of solid material under conditions which include high mass flow rate of gas through the vessel and which produce liquid from the solid material, the improvement comprising:

a solids outlet extending from an outlet end of the vessel;

a liquids outlet extending from said outlet end of the vessel, said liquids outlet being positioned above said solids outlet; and a plurality of gas outlets extending from said outlet end of the vessel being separate from said solids outlet and said liquids outlet, said plurality of gas outlets being positioned above said solids outlet and said liquids outlet for maintaining a substantially constant flow velocity of gas in a region of the vessel below said plurality of gas outlets.

2. The improvement defined in claim 1 wherein said outlet end is in a lower section of the vessel.

3. The improvement defined in claim 2 wherein the outlet end includes a plurality of gas outlets.

4. The improvement defined in claim 3 wherein the gas outlets are located at more than one level of the outlet end.

5. The improvement defined in claim 1 wherein said plurality of gas outlets are located at more than one level of said outlet end.

6. The improvement of claim 1 further including a deflector associated with at least one of said plurality of gas outlets to prevent direct access of liquid and gas flowing downwardly through said at least one gas outlet.

7. The improvement defined in claim 6 wherein the deflector of said at least one gas outlet includes a plate extending downwardly and inwardly into the vessel from a location above said at least one gas outlet.

8. The improvement defined in claim 7 wherein the plate extends at least partially around the inside face of the vessel and defines a downwardly opening channel for receiving gas flowing downwardly through the vessel.

9. The improvement defined in claim 6 wherein the deflector of the at least one gas outlet includes a screen extending downwardly and inwardly into the vessel from a location above the at least one outlet.

10. An apparatus for processing a charge of a solid material under conditions which include high mass flow rate of gas through the apparatus and which produce liquid from the solid material, said apparatus comprising:

(a) a vessel having:

(i) an inlet end having an inlet for supplying the solid material to form a packed bed in said vessel; and (ii) an outlet end having a solids outlet extending therefrom, a liquids outlet positioned above said solids outlet, and a plurality of gas outlets positioned above said solids and liquids outlets for maintaining a substantially constant flow velocity of gas in a region of the vessel below said plurality of gas outlets, said plurality of gas outlets being provided separate from said solids and liquids outlets;

(b) a means for supplying a fluid to pressurize the packed bed; and (c) a means for supplying a heat exchange medium to heat the solid material in the packed bed.

11. The apparatus defined in claim 10 wherein said outlet end is in a lower section of the vessel relative to said inlet end.

12. The apparatus defined in claim 11 wherein the outlet end includes a plurality of gas outlets.

13. The apparatus defined in claim 10 wherein said plurality of gas outlets are located at more than one level of said outlet end.

14. The apparatus defined in claim 13 wherein at each level that has a plurality of gas outlets the gas outlets are spaced around the perimeter of the vessel so that across that level there is a generally uniform downward flow of gas.

15. The apparatus defined in claim 10 further including a deflector associated with at least one of said plurality of gas outlets to prevent direct access of liquid and gas flowing downwardly through said at least one gas outlet.

16. The apparatus defined in claim 15 wherein the deflector of said at least one gas outlet includes a plate extending downwardly and inwardly into the vessel from a location above said at least one gas outlet.

17. The apparatus defined in claim 16 wherein the plate extends at least partially around the inside face of the vessel and defines a downwardly opening channel for receiving gas flowing downwardly through the vessel.

18. The apparatus defined in claim 10 wherein the means for supplying the heat exchange medium supplies the medium to heat the solid material by indirect heat exchange.

19. The apparatus of claim 10 wherein the vessel is a pressure vessel.

20. A process for processing a charge of a solid material under conditions which include high mass flow rate of gas and which produce liquid from the solid material, which process includes:

(a) supplying the solid material to a vessel to form a packed bed of the solid material;

(b) pressurising the packed bed;

(c) heating the solid material by heat exchange with a heat exchange medium, whereby the combined effect of pressure and heat is to release water and other liquid and/or gaseous compounds from the solid material, with part of the released water being in a gas phase and part of the water being in a liquid phase;

(d) discharging gas from the packed bed via at least one gas outlet in the vessel; and (e) discharging liquid from the packed bed via a liquid outlet in the vessel located below the gas outlet.

21. The process defined in claim 20 further including discharging gas from the packed bed via a plurality of gas outlets so that there is substantially constant flow velocity of gas in the packed bed in the outlet end.

22. The process defined in claim 20 further including discharging gas from the packed bed via gas outlets at two or more levels above the liquid outlet.

23. (Amended) The process defined in claim 22 further including discharging gas via a plurality of gas outlets located at least at one of the levels above the liquid outlet.

24. An improvement to a vessel for processing a charge of solid material under conditions which include high mass flow rate of gas through the vessel, the improvement including providing the vessel with at least one solids outlet for discharging solids from the vessel and a plurality of gas inlets and/or gas outlets for introducing gas into or discharging gas from the vessel at one or more levels of the vessel above the solids outlet or outlets.

* * * * *

UNITED STATES PATENT AND TRADEMARK OFFICE

CERTIFICATE OF CORRECTION

PATENT NO. : 6,266,894 B1
DATED : July 31, 2001
INVENTOR(S) : David Stewart Conochie It is certified that error appears in the above-identified patent and that said Letters Patent is hereby corrected as shown below:

Title page, Item [54] and Column 1, lines 1-2,
The Title, delete "VESSEL APPARATUS".

Item [56], References Cited, under OTHER PUBLICATIONS, "(Form PCT/ISA0210)", should be -- (Form PCT/ISA/210) --.

Item [57], the ABSTRACT should read as follows:
-- A process and an apparatus for processing a charge of a solid material under conditions which include high mass flow rate of gas through the apparatus and which produce liquid from the solid material includes a vessel having (i) an inlet end having an inlet for supplying the solid material to form a packed bed in the vessel; and (ii) an outlet end having a solids outlet, a liquids outlet, and a plurality of gas outlets being positioned above the solids and liquids outlets. --

Column 8,
Line 65, delete "(Amended)".

Signed and Sealed this

Twentieth Day of August, 2002

*Attest:*

*Attesting Officer*

JAMES E. ROGAN
*Director of the United States Patent and Trademark Office*